United States Patent [19]

Held et al.

[11] Patent Number: 4,613,370

[45] Date of Patent: Sep. 23, 1986

[54] HOLLOW CHARGE, OR PLATE CHARGE, LINING AND METHOD OF FORMING A LINING

[75] Inventors: Manfred Held, Aresing; Alfred Leidig, Schrobenhausen; Wilhelm A. Merl, Pforzheim; Günter Stempel, Kelkheim, all of Fed. Rep. of Germany

[73] Assignees: Messerschmitt-Bolkow Blohm GmbH; Bayerische Metallwerke GmbH, both of Fed. Rep. of Germany

[21] Appl. No.: 657,342

[22] Filed: Oct. 3, 1984

[30] Foreign Application Priority Data

Oct. 7, 1983 [DE] Fed. Rep. of Germany ..... 3336516

[51] Int. Cl.[4] ..... C22C 27/04

[52] U.S. Cl. ..... 75/248; 75/247; 102/306; 419/23; 419/26; 419/27; 419/28; 419/65; 106/286.7

[58] Field of Search ..... 102/306–310, 102/476; 419/36, 37, 26, 28, 23, 27, 65; 75/247, 248; 106/286.7

[56] References Cited

U.S. PATENT DOCUMENTS

| | | | |
|---|---|---|---|
| 4,190,753 | 2/1980 | Gainer | 419/60 |
| 4,430,124 | 2/1984 | Kato | 75/248 |
| 4,463,678 | 8/1984 | Weimer et al. | 102/308 |
| 4,498,367 | 2/1985 | Skolnick et al. | 102/306 |

*Primary Examiner*—Stephen J. Lechert, Jr.
*Attorney, Agent, or Firm*—McGlew and Tuttle

[57] ABSTRACT

A hollow charge, or plate charge, lining, and a projectile charge coating, made from a composite material of tungsten and copper. Indicated are material proportions, grain sizes, and manufacturing methods.

17 Claims, No Drawings

HOLLOW CHARGE, OR PLATE CHARGE, LINING AND METHOD OF FORMING A LINING

FIELD AND BACKGROUND OF THE INVENTION

The invention relates in general to ammunition and in particular to a new and useful hollow charge, or plate charge, lining, or a projectile charge coating and to a method of making it.

Such explosive charges provided with a mostly conical cavity having a cone angle of selected ranges and located substantially at the projectile side directly facing the target, as known in a variety of designs.

For example, German No. OS 29 13 103 discloses a flat cone charge with a cavity which is aligned with a metal insert made of an alloy having such a high tantalum content that a density is obtained exceeding that of copper. Tungsten and various other alloy metals also are provided for that alloy. Experience has shown, however, that due to the considerably different properties of the employed metals, these prior art copper alloys exhibit a relatively insufficiently homegeneous density and structure, reducing the piercing capacity of the explosive charge.

It is known that the surface texture of a hollow or plate charge lining considerably influences the cutting power or cutting depth, so that surface roughness, variation in thickness, oxide films, etc. are undesirable. As a remedy and to obtain a material easy to work for the mentioned purposes, German Pat. No. 27 24 036 shows the manufacture of an insert in a pressing process, of a copper bismuth alloy. However, the same applies to this method as above, namely that no satisfactory homogeneity is obtained.

SUMMARY OF THE INVENTION

The present invention is directed to a lining or coating material for explosives which is homogeneous and leads to an improved penetration.

This problem is solved in a surprisingly reliable manner by providing the features set forth in the claims.

In the following, embodiments are described and explained.

DESCRIPTION OF THE PREFERRED EMBODIMENTS

The cutting power and cutting depth of a hollow charge is given in a first approximation by the sum of the spike lengths at the crater bottom multiplied by the root of the ratio of the lining material density to the target material $$T = \Sigma L \cdot \sqrt{P\,(\text{Spikes})/P1\,(\text{Target Material})}$$

It results from this formula that by employing a heavy metal, such as tungsten having a crystal density of 19.2 grams per $cm^3$, a considerably better penetration depth can be obtained, as compared to copper having a density of 8.9 gram per $cm^3$. Only, pure tungsten material cannot be worked as a homogeneous lining to the required wall thickness of 0.5 to 3 mm. That is why tungsten-copper alloys have been considered. However, these alloys still do not satisfy the desired performance data.

For this reason, the invention provides a lining or coating made from a composite material formed of tungsten and copper. The individual tungsten grains are agglutinated with the copper to a homogeneous structure by means of a binder, such as nickel or palladium. The ductility of copper is thus combined with the heavy tungsten particles to a spike of high density, and a material with optimum properties for this purpose is obtained.

The tungsten proportion should range between 50% and 95%, and the homogeneous compound material obtained by pressing, sintering, and repressing with copper should be finish-formed to the desired shape. According to experience, a tungsten proportion of 60% to 80% results in an optimum material suitable for many applications. In this case, the tungsten particles are embedded as a matrix in copper.

Another possibility of obtaining the composite material is to isostatically compress tungsten powder and copper powder along with the binder, for example nickel or palladium, under a high temperature exceeding the melting point of copper.

Still another method provides a mechanical compression of pure tungsten material with suitable binders, followed by a sintering process, and in a second operating step, infiltration of the copper proportion, with again pressing the material directly to the desired shape. This saves not only material but also operating time.

While specific embodiments of the invention have been shown and described in detail to illustrate the application of the principles of the invention, it will be understood that the invention may be embodied otherwise without departing from such principles.

Further it is proposed that the grain size of tungsten for the composite material ranges from between 2 microns to 90 microns. The grain sizes of the tungsten ranges from 30 to 60 microns showed to be most favourable.

What is claimed is:

1. Coating material in shaped form for use as hollow charge, plate charge lining and projectile charge coating, comprising a composite binder material formed from particles of tungsten and copper in the presence of a binder metal and having a homogeneous structure in which the individual tungsten particles are agglutinated substantially with the copper by means of the binder metal.

2. Coating of claim 1, wherein the composite material comprises 50–95% tungsten.

3. Coating of claim 1, wherein the composite material comprises 60–80% tungsten.

4. Coating of claim 1, wherein the tungsten has a particle size of 2–90 microns.

5. Coating of claim 1, wherein the tungsten has a particle size of 30–60 microns.

6. Coating of claim 1, wherein the binder metal is one of nickel and palladium.

7. Coating material in shaped form for use as hollow charge, plate charge lining and projectile charge coating according to claim 1, comprising a composite binder material formed from particles of tungsten and copper in the presence of one of nickel and palladium as binder metal and having a homogeneous structure in which the individual tungsten particles have a grain size of 2–90 microns and are agglutinated substantially with the copper by means of the binder metal, the composite material comprising 50–95% tungsten.

8. Coating material in selectively shaped form for use as hollow charge, plate charge lining and projectile charge coating, comprising a composite material formed from particles of tungsten and copper and having a homogeneous structure of selective shape for such use in which the individual tungsten particles are agglutinated substantially with the copper.

9. Method of forming a coating material in shaped form made of a composite binder material of tungsten and copper for use as hollow charge, plate charge lining and projectile charge coating, comprising agglutinating to a homogeneous structure of selective shape individual particles of tungsten with copper in the presence of one of nickel and palladium as binder metal.

10. Method of claim 9, wherein from 50–95% tungsten is used.

11. Method of claim 9, wherein from 60–80% tungsten is used.

12. Method of claim 9, wherein the tungsten is used in a particle size of 2–90 microns.

13. Method of claim 9, wherein the tungsten is used in a particle size of 30–60 microns.

14. Method of claim 9, wherein the tungsten is treated by sintering and pressing, and thereafter combined with copper and repressed.

15. Method of claim 9, wherein the tungsten is compressed in powder form and copper powder is added with the binder metal at a temperature greater than the melting point of copper.

16. Method of claim 9, wherein pure tungsten is pressed with the binder metal and copper is added and the copper is repressed.

17. Method of forming a coating material in shaped form made of a composite binder material of tungsten and copper for use as hollow charge, plate charge lining and projectile charge coating according to claim 9, comprising agglutinating to a homogeneous structure of selective shape individual particles of tungsten in a particle size of 2–90 microns with copper in the presence of one of nickel and palladium as binder metal and such that the proportion of tungsten present comprises 50–95% of the composite material.

* * * * *